US006322286B1

(12) United States Patent
Rijkers

(10) Patent No.: US 6,322,286 B1
(45) Date of Patent: Nov. 27, 2001

(54) VIBRATING SCREED AND METHOD OF MAKING SAME

(75) Inventor: Wilhelmus Cornelis Henricus Maria Rijkers, Neerpelt (BE)

(73) Assignee: B-Mac besloten vennootschap met beperkte aansprakelijkheid, Overpelt (BE)

( * ) Notice: Subject to any disclaimer, the term of this patent is extended or adjusted under 35 U.S.C. 154(b) by 0 days.

(21) Appl. No.: 09/463,417

(22) PCT Filed: Jul. 28, 1998

(86) PCT No.: PCT/BE98/00117

§ 371 Date: Feb. 4, 2000

§ 102(e) Date: Feb. 4, 2000

(87) PCT Pub. No.: WO99/07941

PCT Pub. Date: Feb. 18, 1999

(30) Foreign Application Priority Data

Aug. 5, 1997 (BE) ..... 9700662

(51) Int. Cl.[7] ..... E01C 19/22; E01C 19/38; E01C 19/40; B23P 17/00

(52) U.S. Cl. ..... 404/114; 424/118; 425/456; 29/414; 29/898.07

(58) Field of Search ..... 404/133.05, 133.1, 404/114, 118, 119, 120, 97; 425/456, 458; 15/235.4, 235.8; 29/412–414, 421.1, 557, 898.07

(56) References Cited

U.S. PATENT DOCUMENTS

| | | | | |
|---|---|---|---|---|
| 4,650,366 | * | 3/1987 | Morrison | 404/114 |
| 4,832,525 | * | 5/1989 | Morrison | 404/114 |
| 4,838,730 | * | 6/1989 | Owens | 404/114 |
| 5,212,995 | * | 5/1993 | Robinson et al. | 29/898.07 X |
| 5,244,305 | * | 9/1993 | Lindley | 404/97 |
| 5,803,656 | * | 9/1998 | Turck | 404/118 X |
| 5,857,803 | * | 1/1999 | Davis et al. | 404/114 X |
| 6,089,787 | * | 7/2000 | Allen et al. | 404/118 |
| 6,200,065 | * | 3/2001 | Eitzen | 404/114 |

FOREIGN PATENT DOCUMENTS

| | | | | |
|---|---|---|---|---|
| 562248 | * | 11/1957 | (BE) | 404/114 |

* cited by examiner

*Primary Examiner*—David Bagnell
*Assistant Examiner*—Sunil Singh
(74) *Attorney, Agent, or Firm*—Bacon & Thomas, PLLC

(57) ABSTRACT

A vibrating screed for processing a floor layer, more particularly a so-called vibrating beam, of the type including a vibrating board (2), a vibrating mechanism (3) cooperating with the vibrating board, and a handle (4) whereby the vibrating mechanism comprises an eccentric (7) seated in bearings (5–6) and a motor (8) for driving the eccentric, wherein the bearings and the eccentric are fixed in a split body by means of a clamping mechanism on the split body.

14 Claims, 3 Drawing Sheets

4
11
3
8
9
27
31
III
22
10
27
III
33
32
2
21
1
F2

16
17
20
20
13
14
D
D
35
19
31
A
25
B
38
37
20
20

34
32
33
36
19
25
21
21

VIBRATING SCREED AND METHOD OF MAKING SAME

BACKGROUND OF THE INVENTION

1. Field of the Invention

This invention relates a vibrating device for processing a floor layer, more particularly a so-called vibrating beam or screed, of the type substantially consisting of a vibrating board, a vibrating mechanism cooperating with the vibrating board, and a handle, whereby the vibrating mechanism substantially consists of an eccentric seated in bearings and a motor for driving the eccentric, and the bearings and the eccentric born therein are fixed by means of a clamping mechanism.

2. Related Art

Such vibrating devices are applied for spreading and smoothing of hardenable materials when forming a floor layer, more particularly materials such as concrete and similar.

The known embodiments of such vibrating devices show the disadvantage that the mounting thereof is rather complicated and, consequently, time-consuming This is for instance the case with the vibrating device disclosed in U.S. Pat. No. 5,244,305. This device comprises a rotating off-center weight borne in a vertical collar which is mounted on a framework consisting of a horizontal strip and two vertical strips bolted to the horizontal strip and clamped by bolts onto the vibrating board.

The invention aims at a vibrating device, more particularly a vibrating beam, which does not show this disadvantage.

The invention also aims at a vibrating device in which the eccentric is fixed in the vibrating device in a very efficient manner.

SUMMARY OF THE INVENTION

To this end, the invention aims at a vibrating device of the aforementioned type, with the characteristic that the clamping mechanism substantially consists of, on one hand, a body in which a seat for the bearings is provided, said body being split apart at one side of the seat, such that the body shows at least two portions which can be drawn towards each other, and, on the other hand, tensioning means for drawing the aforementioned portions towards each other and thereby clamping the bearings of the eccentric in the seat.

The clamping mechanism is constructed in such a manner that it shows a minimum of parts, which allows for a rapid mounting and dismounting.

U.S. Pat. No. 4,650,366 describes a vibrating device having an elongated beam comprising tubular sections wherein a vibrating shaft is mounted by means of loose bearings. Sleeves are secured by set screws fit tightly on the vibrating shaft and mount said bearings so as to fit loosely within the tubular section.

According to the invention, preferably, the aforementioned body consists of an extruded body, whereas the aforementioned seat is formed by a through channel in this body.

Furthermore, this body preferably comprises also a number of provisions which allow to establish a connection with the other components, such as the motor, the handle, and the vibrating board. These provisions may consist of profiles for the attachment of the handle and the motor, as well as flanges, for example, for connecting the body to the vibrating board. The use of such profiles and flanges offers the advantages that these can easily be formed at the body by means of extrusion, and that they allow for a relatively simple connection with the other components.

The invention also relates to a method for the construction of such a vibrating device, which method comprises the steps of extruding a profile, whereby this profile, during the extrusion, is provided with a cylindrical channel; forming of a body out of the profile by separating a well-defined length from the profile; arid finally assembling the body, the vibrating board, the vibrating mechanism, and the handle; with the characteristics that the body is split apart at one side by applying, before or after the separation of the body, a recess in the body which recess continues up into the channel, such that the body shows at least two portions which can be drawn towards each other; and that, after assembly, the eccentric is clamped at its bearings into the aforementioned body by drawing to each other said portions.

BRIEF DESCRIPTION OF THE DRAWINGS

With the intention of better showing the characteristics according to the invention, hereafter, as an example without any limitative character, a preferred form of embodiment is described, with reference to the accompanying drawings, wherein.

DETAILED DESCRIPTION OF PREFERRED EMBODIMENT

Figure 1:
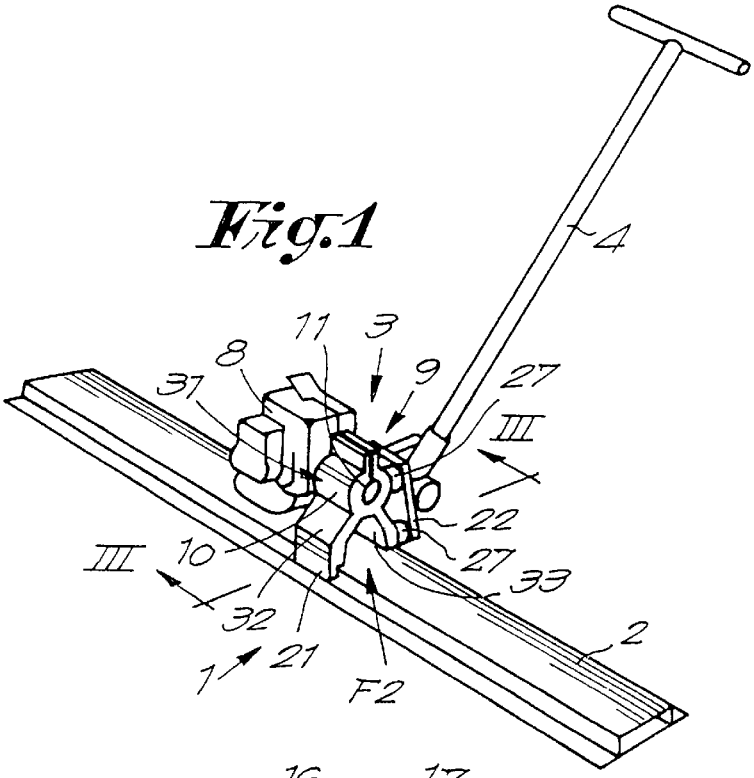
FIG. 1, in perspective, schematically represents a vibrating device according to the invention.
Figure 2:
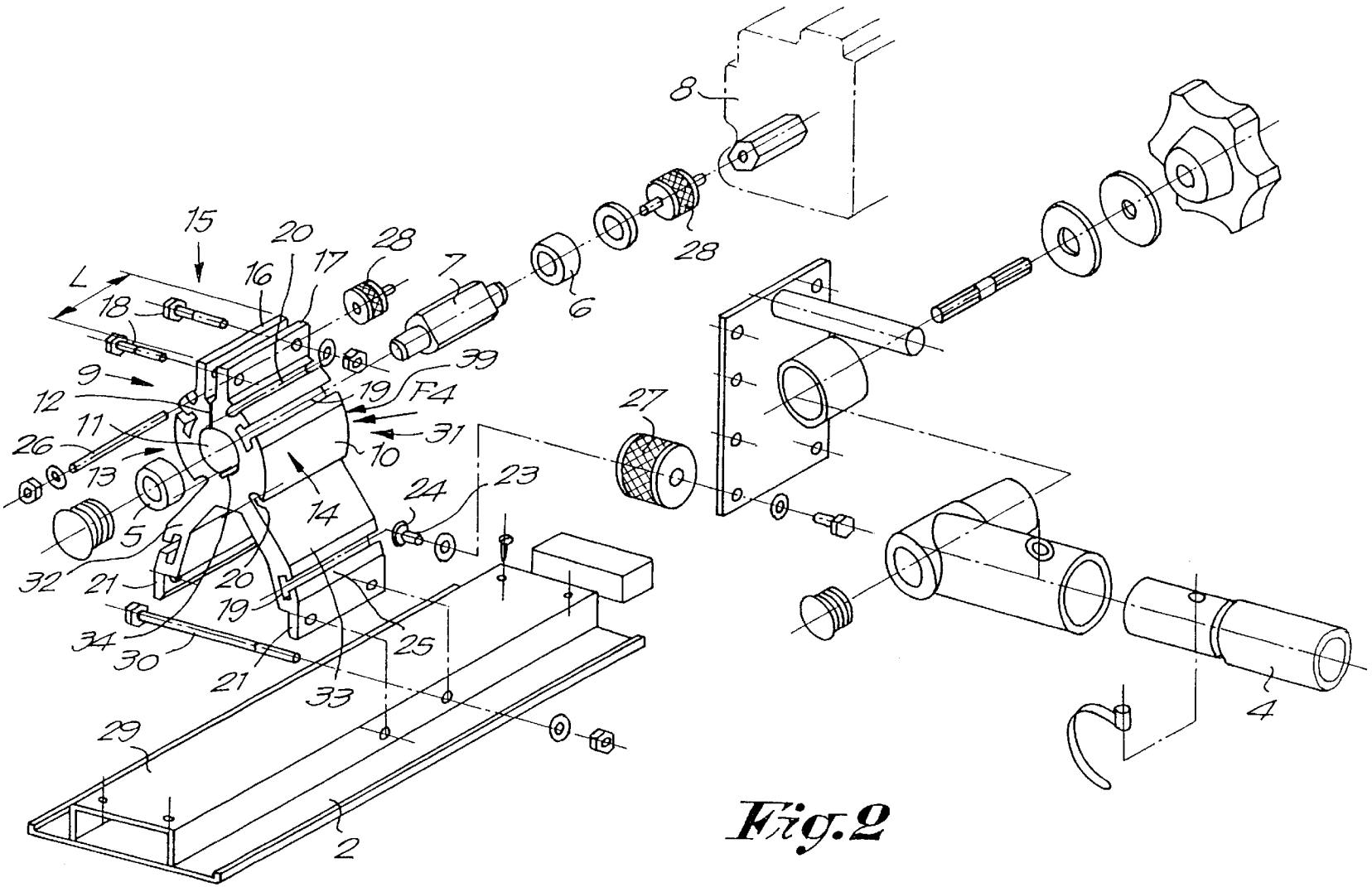
FIG. 2 represents the part which is indicated by arrow F2 in FIG. 1, in exploded view.
Figure 3:
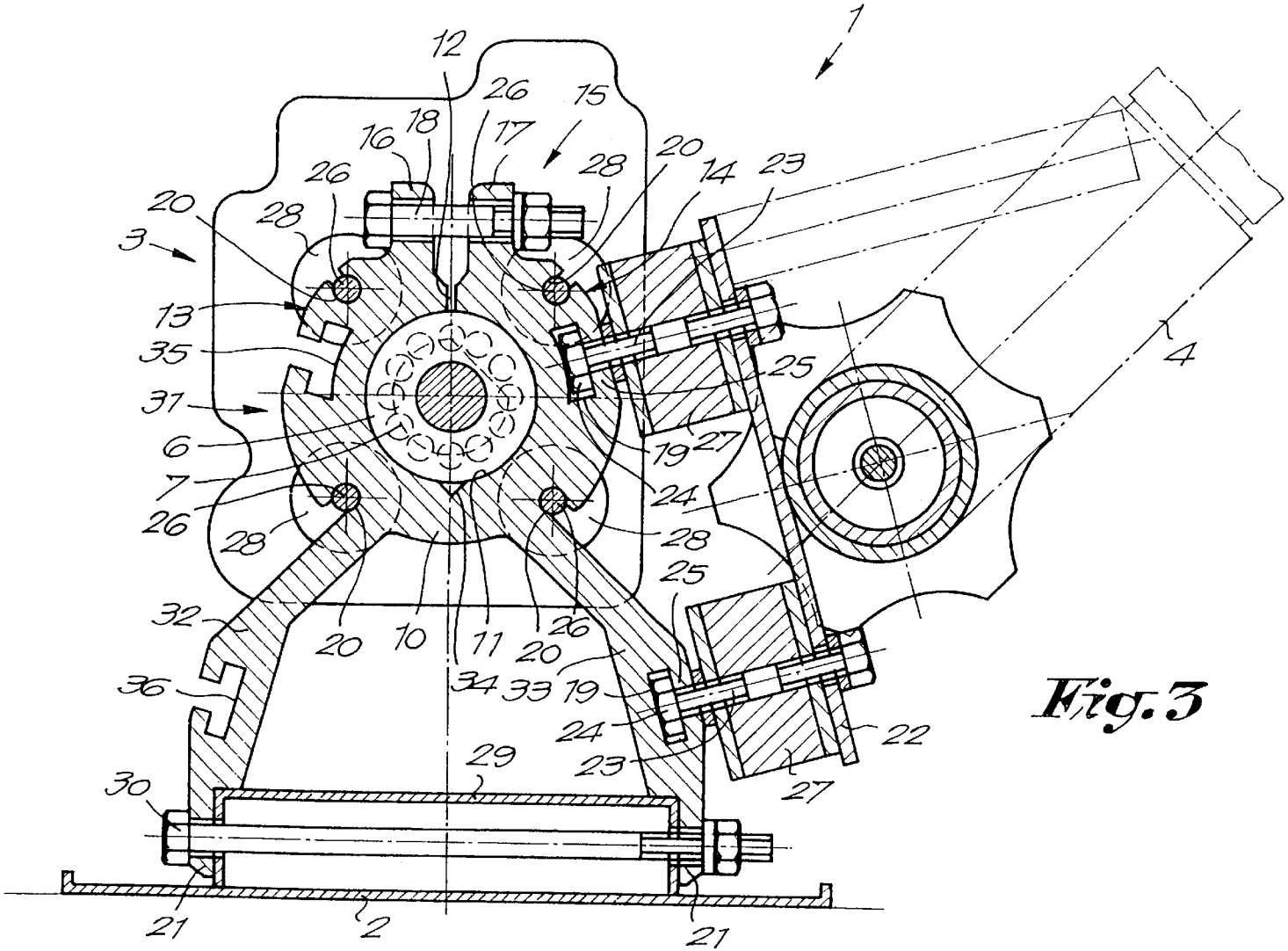
FIG. 3 represents a cross-section according to line III—III in FIG. 1.

As represented in FIG. 1, the vibrating device 1 of the invention substantially consists of a vibrating board 2, a vibrating mechanism 3 cooperating with the vibrating board 2, and a handle 4. As represented in FIG. 2, the vibrating mechanism 3 substantially is formed by an eccentric 7 seated in bearings 5–6, and a motor 8 for driving the eccentric 7.

The particularity of the invention consists in that the bearings 5–6 and the eccentric 7 beared therein are fixed by means of a clamping mechanism 9.

The clamping mechanism 9 substantially consists of, on one hand, a body 10 in which a cavity or seat 11 for the bearings 5–6 is provided, whereby the body 10 is split apart at one side of the seat 11, more particularly, comprises a through recess 12, in such a manner that the body 10 shows at least two split body portions 13–14 which can be drawn towards each other, and, on the other hand, tensioning means 15 for drawing the aforementioned portions 13–14 towards each other and thereby clamping the bearings 5–6 of the eccentric in the seat 11.

The seat 11 is formed by a through opening or channel. As represented, the tensioning means 15 preferably consist of flanges 16–17, formed at the body 10, which can be drawn towards each other by means of bolts 18.

In the most preferred form of embodiment, the body 10 consists of an extruded body.

As shown in the represented form of embodiment, the body 10 preferably comprises various provisions which allow to make a connection with the other components, such as the motor 8, the handle 4, and the vibrating board 2.

Amongst others, these provisions comprise profiles 19 for the fixation of the handle 4; profiles 20 for the fixation of the motor 8, and flanges 21 which allow to connect the body 10 to the vibrating board 2.

The profiles 19 consist of T-shaped grooves. The handle 4 is provided with a fixation plate 22 which is fixed at the body 10 by means of bolts 23, the heads 24 of which engage behind the edges 25 of the T-shaped grooves.

The profiles 20 consist of laterally partially open channels which are situated at the circumference of the body 10. The motor 8 is fixed at the body by means of bolts or threaded rods 26 extending through these channels in longitudinal direction.

The handle 4 as well as the motor 8 are fixed at the aforementioned body 10 by means of damping element 27–28 which, for example, are formed of rubber.

The aforementioned flanges 21 are constructed in such a manner that they fit over a fixing portion 29 provided at the vibrating board 2 and can be connected thereto by means of bolts 30.

In general, the aforementioned body 10 preferably consists, as represented, of a split-apart cylindrical part 31 and two legs 32–33 extending downward, whereby the lower parts thereof form the flanges 21. Hereby, the motor 8 preferably is fixed against the axial end of the cylindrical part 31. The handle 4 is fixed laterally against the body 10.

It is noted that below in the seat 11, preferably a recess 34 is provided for the draining of water.

It is also noted that additional profiles, such as the grooves 35–36, can be provided in the body 10. By then providing these profiles symmetrical in respect to the profiles 19, it is obtained that the body 10 can be mounted in two directions.

In the body 10, recesses, such as grooves and similar, may be provided, in such a manner that thinned material sections are created in the body 10 which provide for a good bending of the portions 13–14 during tensioning of the clamping means 15. In the represented example, these grooves are formed by the upper profile 19, the groove 35 opposed thereto, the recess-34, and the profiles 20.

More particularly, each of both aforementioned portions 13–14 will be provided with recesses which, in this case, are formed by the upper profile 19 and the groove 35 which are constructed in such a manner that thinned wall portions are created which extend in the circumferential direction of the seat 11 over a well-defined distance A-B. These wall portions, thus, in the represented example the bottom of the profile 19 and of the groove 35, preferably have a constant thickness D over the distance A-B. These thinned wall portions form bending surfaces which allow to distribute the tension concentrations which are created when the bearings 5–6 are clamped.

As represented, the body 10 preferably will have an axial length L which is so large that the complete eccentric 7, together with the bearings 5–6 present at the extremities thereof, is located within this body 10.

Figure 4:
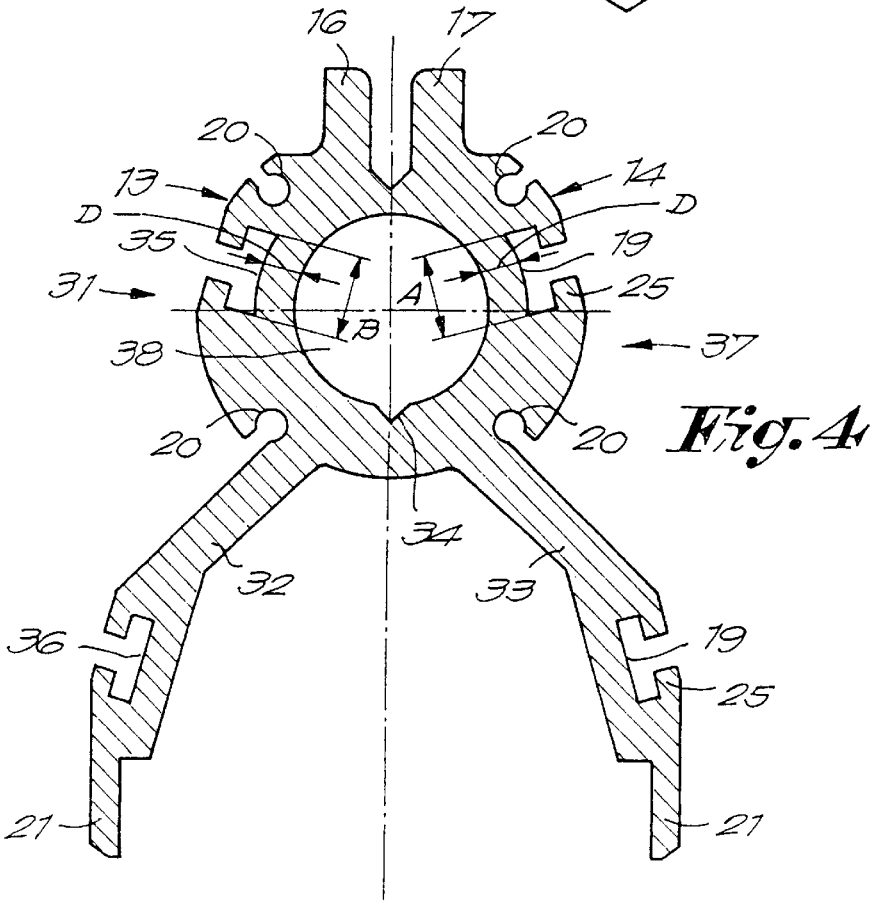
FIG. 4, in cross-section, represents the extruded profile from which the body is formed which is indicated by arrow F4 in FIG. 2.

When constructing the vibrating device 1, one preferably starts with an extruded profile, more particularly a profile 37 as represented in FIG. 4, which is provided with a channel 38 which is intended for subsequently forming the aforementioned seat 11. In this profile 37, more particularly between the flanges 16–17, a recess 12 continues up into the through channel 38. By sawing off, before or after providing the recess 12, a well-defined length from the profile, a body 10, as represented in FIG. 2, is obtained.

During the assembly, the eccentric 7 is slid into the seat 11 together with the bearings 5–6, and subsequently the portions 13–14 around the bearings 5–6 are tensioned by means of tensioning the bolts 18. It is obvious that in this manner, a very rapid mounting is enabled.

The other components, too, can be fixed very fast at the body 10.

The motor 8, for example, is fixed by sliding the bolts or threaded rods 26 through the profiles 20 and tensioning the motor 8 against the axial surface 39 of the body 10, with the inclusion of the damping elements 28.

The manner of fixation of the vibrating board 2 and the handle 4 at the body 10 can simply be deduced from the figures.

It is obvious that different variants of the invention are possible, whereby one or two of the additional characteristics have been omitted.

The present invention is in no way limited to the form of embodiment described by way of example and represented in the figures, on the contrary may such vibrating device, as well as the method for the construction thereof, be realized in various variants without leaving the scope of the invention.

What is claimed is:

1. A vibrating screed comprising:

a vibratable floor layer engaging board;

a handle arranged to manipulate the board;

a vibrating device comprising a rotatable eccentric seating in bearings and a motor connected to the eccentric and arranged to rotate the eccentric in said bearings;

a clamping mechanism comprising a body defining a cavity for receiving and seating said bearings, said body being split at least on one side of the cavity to define split body portions;

a tensioning arrangement connected to the split body portions and configured to be operable to draw the split body portions together to reduce the size of the cavity and to clamp therein the bearing in the cavity.

2. The vibrating screed as claimed in claim 1, said body comprising an extruded member wherein said cavity is formed as a through opening in the body.

3. The vibrating screed as claimed in claim 1, said body including elements connectable to components of the screed, including said motor, said handle and said board.

4. The vibrating screed as claimed in claim 3, said elements comprising first profiles for securing the body to the handle, second profiles for securing the body to the motor and flanges for connecting the body to the board.

5. The vibrating screed as claimed in claim 4, said first profiles comprising T-shaped grooves; a handle fixation plate connected to the handle; bolts having heads securing the fixation plate to the body, said bolt heads located and secured in said T-shaped grooves.

6. The vibrating screed as claimed in claim 4, said second profiles for securing the motor to the body comprising laterally partially open channels on a circumference of the body; and bolts located in said channels connecting the motor to the body.

7. The vibrating screed as claimed in claim 1, said body including thinned material sections adjacent said split body portions, said thinned material sections providing bending flexibility to the body on opposite sides thereof, whereby the body may flex to accommodate drawing of the body portions together upon operation of the tensioning arrangement.

8. The vibrating screed as claimed in claim 7, at least some of said thinned material sections extending circumferentially partially around and adjacent said cavity, whereby compression clamping loads on said bearings may be distributed around the cavity.

9. The vibrating screed as claimed in claim 1, wherein said tensioning arrangement comprises adjacent flanges on each split body portion and bolt fasteners securing the flanges together and arranged to draw the flanges together when manipulated.

10. The vibrating screed as claimed in claim 1, including damping elements disposed between the handle and the body.

11. The vibrating screed as claimed in claim 1, said body comprising a longitudinally divided cylindrical section; a pair of legs connected to and extending transversely away from the cylindrical section; said motor connected to the cylindrical section at one axial end thereof; said handle connected to a lateral side of the cylindrical section and said board is affixed to said legs.

12. The vibrating screed as claimed in claim 1, said eccentric and bearings located in said cavity.

13. A method of making a vibrating screed comprising the steps:

extruding a profile having a cylindrical through opening;

transversely cutting a length of the profile to define a body including said through opening;

using the body to form an eccentric and bearing holder for a vibrating screed;

longitudinally cutting the body along one side of the through opening and creating a recess along the cut area to divide the body into two split body portions separated by the recess along the cut area;

locating and securing an eccentric and associated supporting bearings in the through opening; and assembling the body, eccentric and bearings, along with a drive motor connected to the eccentric and a handle for forming and manipulating the vibrating screed.

14. The method as claimed in claim 13, including securing the supporting bearings in the through opening by drawing together the split body portions across said recess.

* * * * *